US008678514B2

(12) United States Patent
Efthymiou et al.

(10) Patent No.: US 8,678,514 B2
(45) Date of Patent: Mar. 25, 2014

(54) METHOD FOR CONVERTING HYDRATES BURIED IN THE WATERBOTTOM INTO A MARKETABLE HYDROCARBON COMPOSITION

(75) Inventors: Michalakis Efthymiou, Rijswijk (NL); Ulfert Cornelis Klomp, Amsterdam (NL); Thomas Alexander Pasfield, Rijswijk (NL); Kjeld Aaby Sorensen, Rijswijk (NL)

(73) Assignee: Shell Oil Company, Houston, TX (US)

( * ) Notice: Subject to any disclaimer, the term of this patent is extended or adjusted under 35 U.S.C. 154(b) by 101 days.

(21) Appl. No.: 13/148,990

(22) PCT Filed: Feb. 12, 2010

(86) PCT No.: PCT/EP2010/051782

§ 371 (c)(1), (2), (4) Date: Aug. 11, 2011

(87) PCT Pub. No.: WO2010/092145

PCT Pub. Date: Aug. 19, 2010

(65) Prior Publication Data

US 2011/0309668 A1 Dec. 22, 2011

(30) Foreign Application Priority Data

Feb. 13, 2009 (EP) ..... 09152818

(51) Int. Cl.
*E21C 50/00* (2006.01)

(52) U.S. Cl.
CPC ..... *E21C 50/00* (2013.01)
USPC ..... 299/8; 299/9; 37/317

(58) Field of Classification Search
USPC ..... 299/7, 8, 9; 37/307, 317, 320, 323
See application file for complete search history.

(56) References Cited

U.S. PATENT DOCUMENTS

| | | | | |
|---|---|---|---|---|
| 4,053,181 | A | 10/1977 | Saito | 299/9 |
| 4,391,468 | A * | 7/1983 | Funk | 299/8 |
| 4,424,858 | A | 1/1984 | Elliott et al. | 166/53 |
| 4,973,453 | A * | 11/1990 | Agee | 422/614 |
| 5,199,767 | A * | 4/1993 | Jimbo | 299/8 |
| 5,950,732 | A * | 9/1999 | Agee et al. | 166/354 |
| 6,178,670 | B1 * | 1/2001 | Susman et al. | 37/313 |
| 6,209,965 | B1 | 4/2001 | Borns et al. | 299/8 |
| 6,595,280 | B2 * | 7/2003 | Traylor | 166/105.5 |
| 2003/0136585 | A1 | 7/2003 | Matsuo et al. | 175/69 |
| 2005/0092482 | A1 | 5/2005 | Wendland | 166/57 |
| 2008/0088171 | A1 | 4/2008 | Cheng | 299/10 |
| 2009/0077835 | A1 * | 3/2009 | Yu et al. | 37/314 |

FOREIGN PATENT DOCUMENTS

| | | |
|---|---|---|
| CN | 101182771 | 5/2008 |
| JP | 2003083494 | 3/2003 |
| JP | 2003193788 | 7/2003 |
| WO | WO9844078 | 10/1998 |

* cited by examiner

*Primary Examiner* — David Bagnell
*Assistant Examiner* — Michael Goodwin

(57) ABSTRACT

A method for producing hydrocarbons wherein hydrates are excavated from the sea bottom and mixed into a transportable slurry, the slurry being pumped to a support vessel, using near sea bottom positive displacement hydraulic pumps, where the hydrates are converted into a hydrocarbon containing stream, with excavation tailings being pumped down to hydraulic motors to drive the hydraulic pumps.

5 Claims, 6 Drawing Sheets

METHOD FOR CONVERTING HYDRATES BURIED IN THE WATERBOTTOM INTO A MARKETABLE HYDROCARBON COMPOSITION

BACKGROUND OF THE INVENTION

The invention relates to a method for converting hydrates buried in the water bottom into a marketable hydrocarbon composition.

Such a method is known from US patent application US 2008/0088171. In the known method a mixture of methane hydrates and mud is prepared with an underwater mining assembly and then brought to a methane dome near the water surface by a series of buckets that are attached to a pair of rotating chains. The methane hydrate is collected and allowed to decompose into methane and water in the methane dome from where the methane is removed to produce liquefied natural gas or synthetic liquid fuels.

A disadvantage of the known method is that methane hydrates are generally present at water depths of more than 1 kilometer, such that very long chains and a large amount of buckets are required to lift the mixture of methane hydrates and mud to the water surface, so that the known method requires costly and heavy equipment, which makes the known bucket dredging method unsuitable and uneconomic for use at large water depths.

Other underwater hydrate excavation methods are known from U.S. Pat. No. 6,209,965, US patent application US2003/0136585, International patent application WO98/44078 and Chinese patent application CN101182771.

It is an object of the present invention to provide an improved method for producing a marketable hydrocarbon composition from a hydrate deposit buried in the water bottom, which is economic and suitable for use at large water depths.

SUMMARY OF THE INVENTION

In accordance with the invention there is provided a method for converting hydrates buried in a water bottom into a marketable hydrocarbon composition, the method comprising:

inducing an underwater excavator to excavate hydrate cuttings from the hydrate deposit and to mix the excavated hydrate cuttings with water and/or bottom particles to form a pipeline transportable hydrate containing slurry;

inducing a slurry lifting assembly, which is connected to the excavator, to lift the slurry through a riser conduit to a topsides vessel floating at the water surface;

separating the slurry in a slurry separation assembly at or near the topsides vessel into a transportable methane containing intermediate product and a tailings stream;

transporting the transportable methane containing intermediate product to a facility in which the intermediate product is converted into a marketable hydrocarbon composition; and wherein the slurry lifting assembly comprises a slurry pump, which is actuated by the tailings stream.

An advantage of actuating the slurry pump by the tailings stream is that the relatively large density of the tailings stream is used to actuate the slurry pump, which reduces the amount of power required to lift the slurry to the topside vessel and/or to pump the tailings stream back from slurry separation assembly to the slurry lifting assembly, in particular if the slurry lifting assembly is located at a water depth of several hundred meters or several kilometers below the water surface.

It is preferred that:

the tailings stream is pumped down through a tailings return conduit to the slurry lifting assembly by a tailings injection pump at the topsides facility;

the slurry pump is actuated by a hydraulic motor which is actuated by the tailings stream; and the tailings stream is discharged to a tailings disposal site at the water bottom via a flexible tailings disposal pipe which is connected to an outlet port of the hydraulic motor.

The hydraulic motor may be a positive displacement motor and the slurry pump may be a positive displacement pump, which pumps the slurry in a substantially turbulent flow regime through the riser conduit.

The positive displacement pump and motor may comprise a diaphragm pump and motor assembly, which comprises a flexible diaphragm, which is arranged in a substantially vertical orientation in a housing, such that it divides the housing in a hydrate slurry containing chamber and a tailings stream containing chamber.

It is preferred that the hydrate slurry containing chamber and/or the tailings stream containing chamber comprise at least one fluid in and/or outlet port arranged near a lower end of the chamber in order to prevent plugging of the chamber by solid particles in the hydrate slurry and/or tailings stream.

Also claimed is a riser conduit which can include a lower section, an intermediate section, and an upper section. The upper section is provided with a thermal insulation layer, which is operative to maintain a chilled intermediate product at below ambient temperature. The riser conduit also can include a separation assembly arranged between the lower and intermediate sections of the riser conduit. The separation assembly can be capable of separating a hydrate containing slurry into a transportable methane containing intermediate product and a tailings stream. In addition, the rise conduit can be provided with a mixing chamber connected between the upper and intermediate sections of the riser conduit. This mixing chamber can be capable of adding a hydrocarbon carrier liquid to the transportable methane containing intermediate product, which would thereby yield a chilled transportable methane containing intermediate product. This product can be yielded at a temperature below 0 degrees Celsius.

These and other features, embodiments and advantages of the method according to the invention are described in the accompanying claims, abstract and the following detailed description of non-limiting embodiments depicted in the accompanying drawings, in which description reference numerals are used which refer to corresponding reference numerals that are depicted in the drawings.

DETAILED DESCRIPTION OF THE DEPICTED EMBODIMENTS

The assemblies shown in FIGS. 1-5 enable the lifting and conversion of hydrate deposits buried in shallow sediments in deepwater offshore regions into transportable intermediate products, which are then transported by a shuttle tanker or a pipeline to an onshore or offshore facility for converting the intermediate product into a marketable fuel and/or other hydrocarbon composition.

In accordance with the invention hydrates are dredged from underwater hydrate deposits in the seabed using a seabed excavator of a type developed for deepsea mining of other commodities. This will produce a slurry of hydrate, water and sediment which enters an intermediate production facility from which the intermediate product is separated and transported to the surface as described below.

Figure 1:
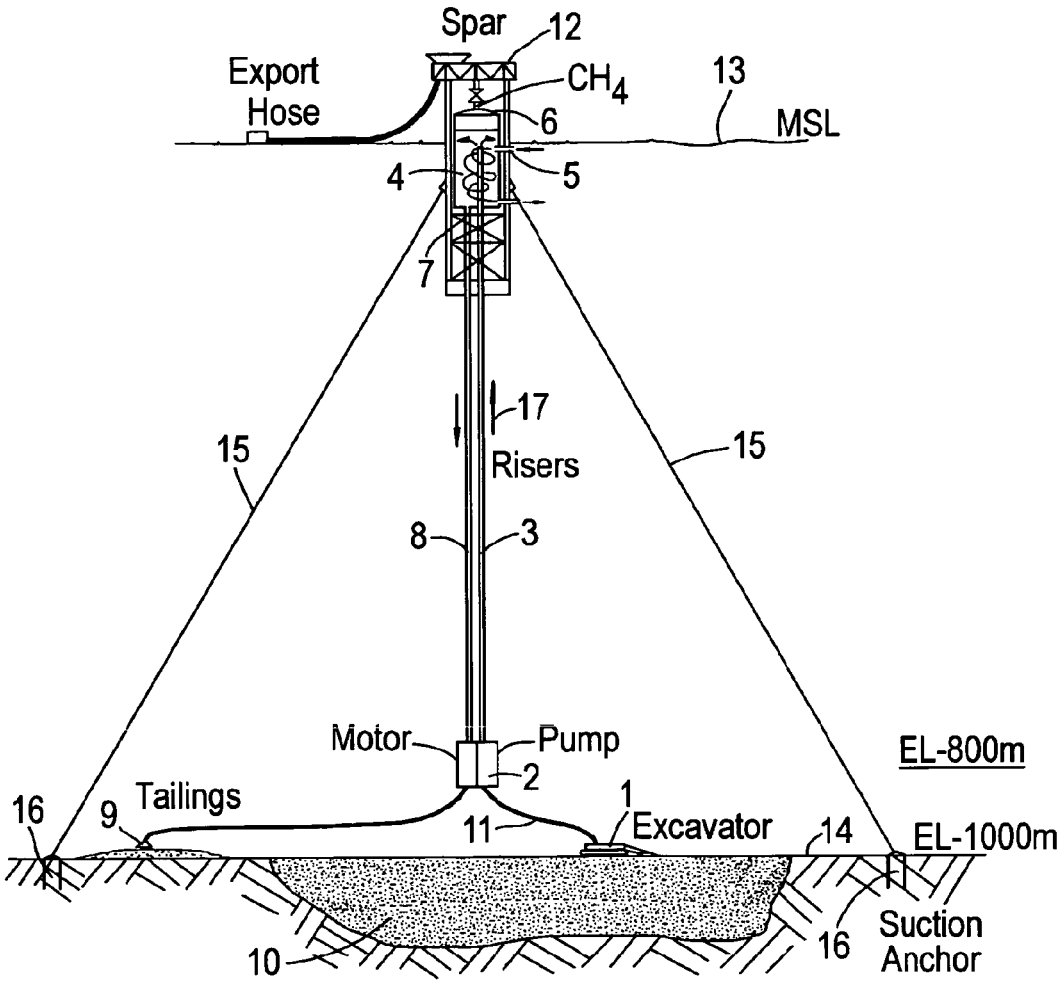
FIG. 1 is a schematic vertical sectional view of a first preferred embodiment of a hydrate slurry lifting and processing assembly in which the method according to the invention is applied.

In the embodiment shown in FIG. 1, a seabed excavator 1 excavates hydrates from a hydrate deposit 10 and passes a slurry 17 of methane hydrate, particulate sediment and seawater through a flexible hose 11 into a slurry riser conduit 3. At a certain depth the slurry passes through a pumping station 2, which raises the pressure of the slurry 17 within the riser and causes it to move upwards in a substantially turbulent flow regime through the slurry riser conduit 3 at a velocity such that settling of solids is minimal. At the top of the slurry riser conduit 3, at the sea surface, the slurry enters a slurry separation assembly 4 at high pressure provided by the pumping station 2. Warm surfacial seawater is also introduced to heat exchanger tubes within the separation assembly 4 on a continuous basis through a seawater inlet 5, such that the methane hydrate is heated causing dissociation into water and methane gas ($CH_4$) at high pressure. The methane gas ($CH_4$) is drawn from the top 6 of the separation assembly 4 and passes through drying and further pressurization stages before being ready for export from the Spar type intermediate production vessel 12, which floats at the water surface 13 and is moored to the seabed 14 by mooring lines 15 that are connected to suction anchors 16 that penetrate the water bottom 14. A tailing stream comprising residual water and sediment is drawn from the bottom 7 of the slurry separation assembly 4 and enters a tailings return conduit 8 to transport it back down to an area of the water bottom 14 suitable for tailings disposal 9.

Figure 2:
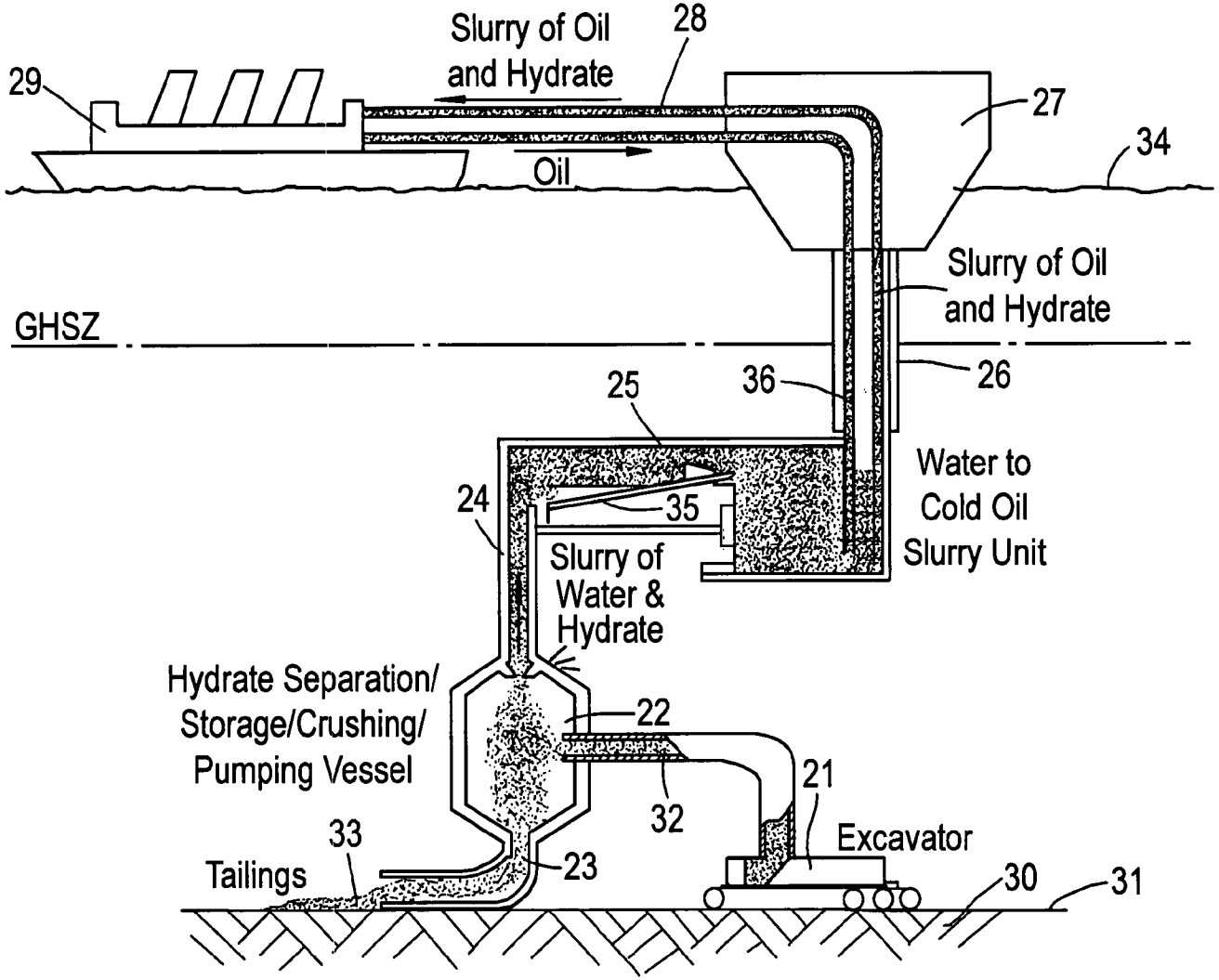
FIG. 2 is a schematic vertical sectional view of a second preferred embodiment of a hydrate cuttings lifting and processing assembly in which the method according to the invention is applied.

FIG. 2 shows an alternative embodiment of a hydrate cuttings lifting and processing assembly in which the method according to the invention is applied.

In this embodiment methane hydrate is produced in its solid state at the topsides at a low temperature within an oil-based slurry. The main advantages of this intermediate product are that the hydrate at low temperature will exhibit a self-preservation effect and therefore remain metastable as a solid substance, which is a convenient phase for shipping, and the slurry can be pumped directly onto the ship without the need for complex solids-handling equipment.

In this version, the seabed excavator 21 excavates hydrates from a hydrate deposit 30 in the seabed 31 and passes a slurry of methane hydrate, particulate sediment and seawater via a flexible hose 32 into a hydrate slurry separation assembly 22. Within the separation assembly 22 the sediment sinks buoyantly and is drawn from the bottom 23 of the assembly 22 and disposed of as tailings 33 at a suitable site.

Within the separation assembly 22 the hydrate fragments float upwards and are drawn off the top of the assembly 22 into a riser 24 as a water/hydrate slurry which then enters a water to oil slurry unit 25, which comprises a conveyor belt 35 and a cold oil injection conduit 36 and is positioned deep enough below the water surface 34 to be within the Gas Hydrate Stability Zone (GSHZ)—possibly on the water bottom 31 attached to the separation assembly 22. The hydrate is moved into a slurry chilled to approximately −20° C. with the carrier being a suitable hydrocarbon (e.g. gasoil) which then passes up a riser 26 to a floating topsides facility 27. At the topsides facility 27 the slurry can be pumped through a hose 28 into a shuttle tanker 29 where the oil is separated from the slurry for re-use. The shuttle tanker 29 then transports the cold solid hydrate to shore for marketing.

Figure 3:
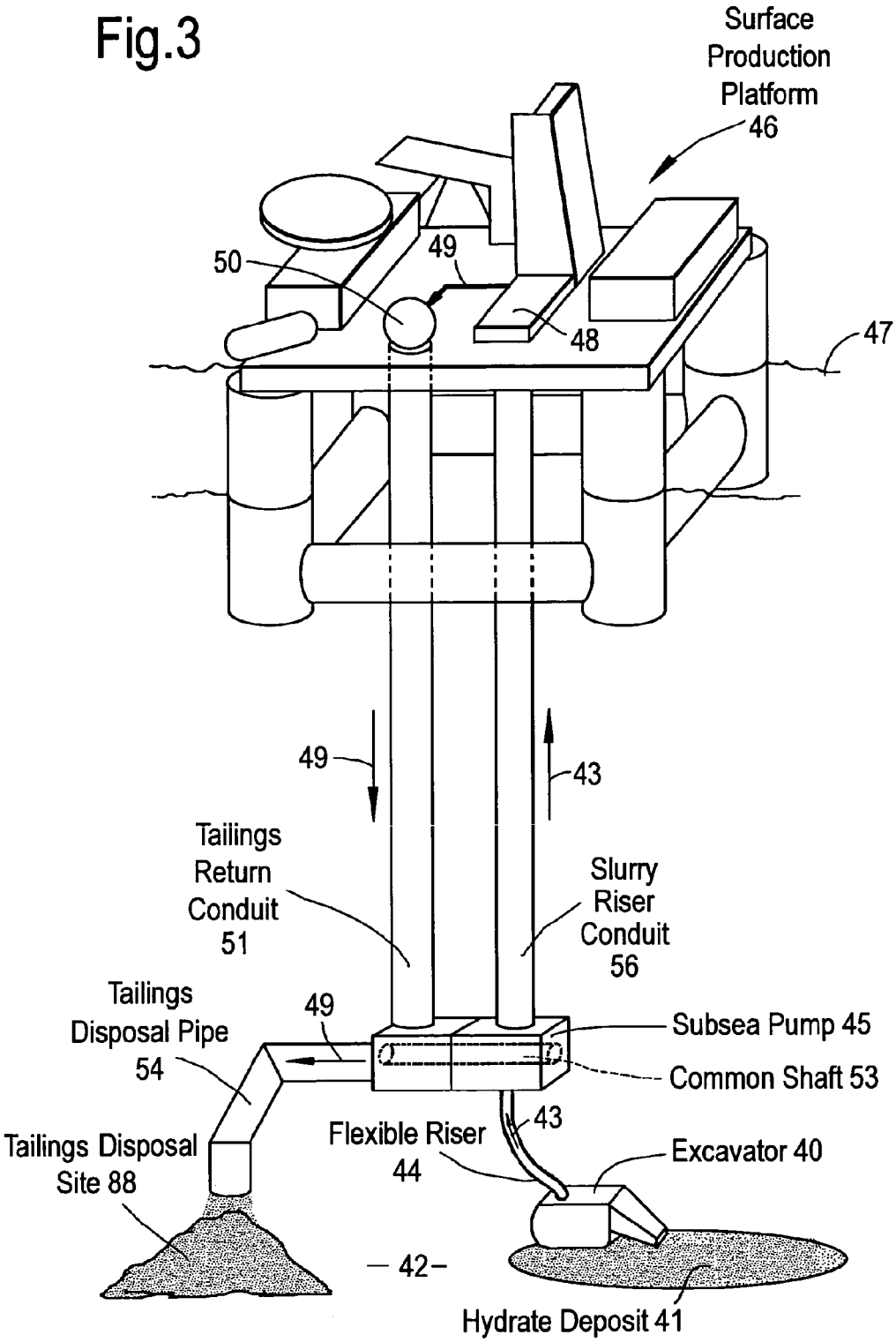
FIG. 3 is a schematic three dimensional view of another preferred embodiment of a hydrate slurry lifting and processing assembly in which the method according to the invention is applied.

FIG. 3 shows another embodiment of the method according to the invention, wherein an excavator 40 excavates a hydrate slurry from a hydrate deposit 41 buried in the water bottom 42 and injects the excavated hydrate, soil and water containing slurry 43 through a flexible riser 44 into a subsea slurry pump 45. The subsea slurry pump 45 pumps the slurry via a slurry riser conduit 56 to a surface production platform 46 floating at the water surface 47. A methane and tailings separation assembly 48 mounted on the platform 46 separates the slurry into a tailings stream 49 and methane containing pumpable product, such as a natural gas composition or Liquid Natural Gas (LNG). The tailings stream is pumped by a high pressure pump 50 into a tailings return conduit 51, which is connected to a hydraulic motor 52. The hydraulic motor 52 actuates the subsea pump 45, for example by mounting the pump 45 and motor 52 on a common shaft 53. The pump 45 and motor 52 may comprise rotodynamic assemblies, such as turbines or centrifugal devices, or may be positive displacement devices, such as piston pumps and motors, twin screw pumps and motors, moineau pumps and motors.

The tailings stream 49 discharged by the hydraulic motor 52 flows through a flexible tailings disposal pipe 54 to a tailings disposal site 88 at the water bottom 42.

Figure 4:
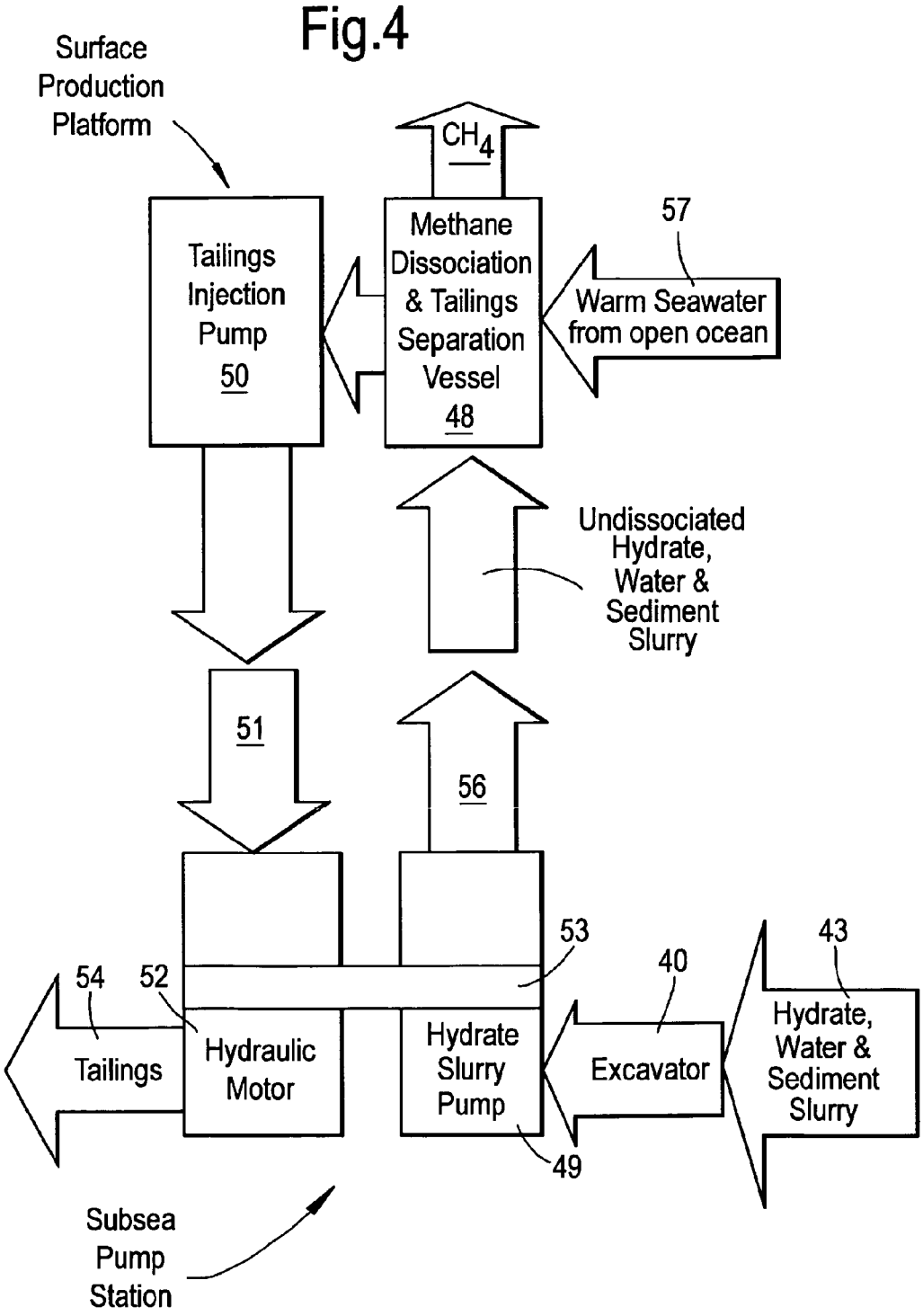
FIG. 4 is a flow-scheme of a slurry excavation, lifting and separation scheme according to the invention.

FIG. 4 is a flow-scheme of the assembly shown in FIG. 3, in which similar components are designated by similar reference numerals as in FIG. 3. FIG. 4 also illustrates, as illustrated by arrow 57, that relatively warm seawater from the water surface 47 may be used to heat the excavated hydrate slurry 43 in the methane-tailings separator assembly 48.

Figure 5:
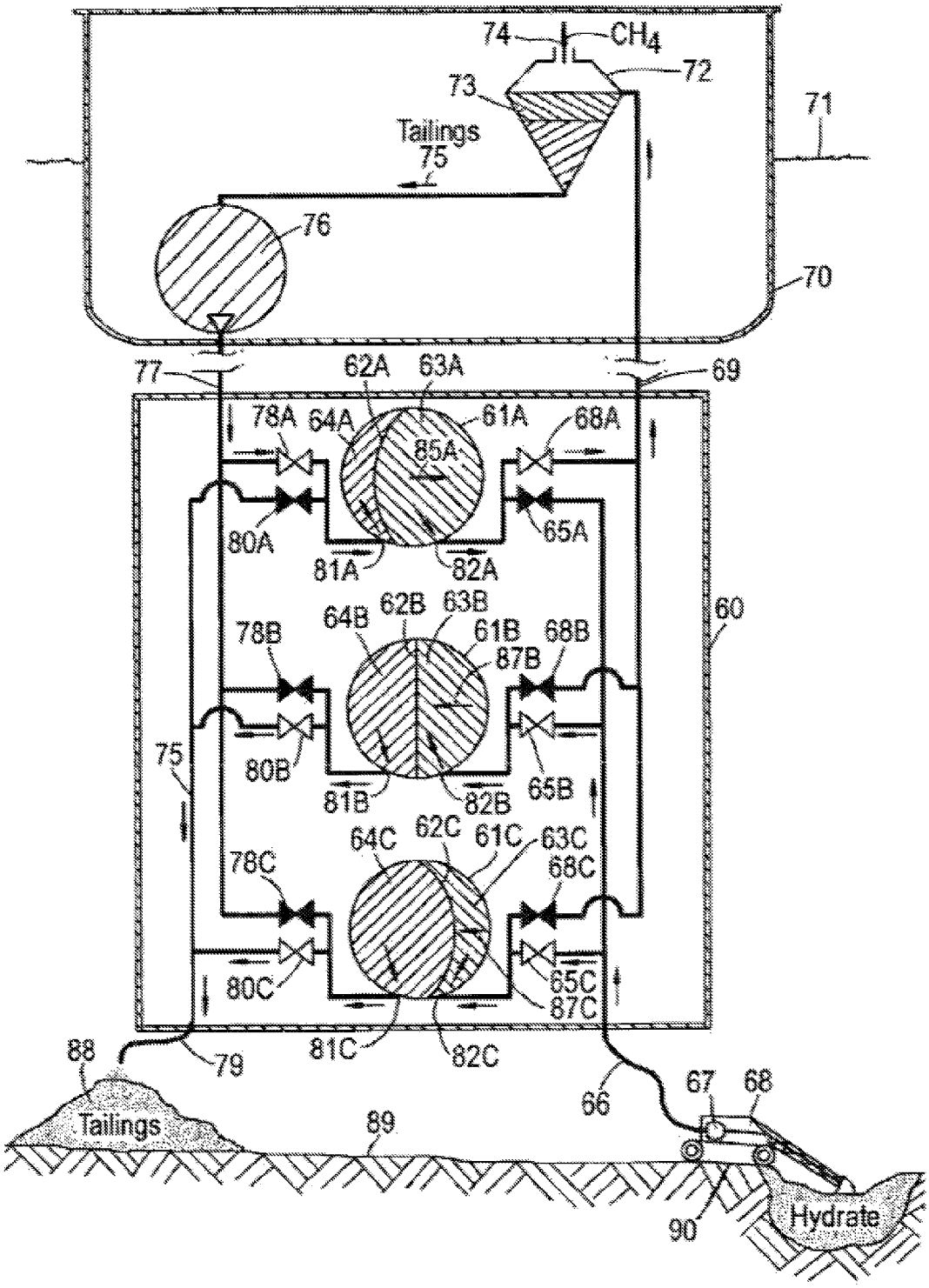
FIG. 5 is a schematic view of a slurry excavation, lifting and separation scheme according to the invention, wherein the hydraulic pump and motor assemblies comprise diaphragm pumps and motors.

FIG. 5 shows another preferred embodiment of a subsea pump station 60 for use in the method according to the invention, wherein the pump station comprise three diaphragm pump and motor assemblies 61A-C.

Each assembly 61A-C comprises a spherical housing in which a substantially vertical flexible membrane 62A-C is arranged, which divides the interior of the housing into a hydrate slurry containing chamber 63A-C and a tailings stream containing chamber 64A-C.

Each hydrate slurry containing chamber 63A-C is connectable via a first valve 65A-C to a flexible riser 66 connected to a pump 67 mounted on an excavator 68 and via a second valve 68A-C to a slurry riser conduit 69. The excavator 68 can be a crawler provided with tracks 90.

The slurry riser conduit 69 is suspended from a production vessel 70, which floats at the water surface 71 and carries a slurry separation assembly 72 into which the slurry riser conduit 69 discharges the hydrate slurry 73 and in which the slurry 73 is separated into a methane ($CH_4$) stream 74 and a tailings stream 75.

The tailings stream 75 is pumped by a high pressure multiphase pump 76 into a tailings return conduit 77, which is connectable to each tailings stream containing chamber 64A-C via a third valve 78A-C.

Each tailings stream containing chamber 64A-C is furthermore connectable to a flexible tailings disposal pipe 79 via a fourth valve 80A-C.

The first to fourth valves are connected to fluid in and outlet ports 81A-C and 82A-C, which are arranged near a lower end of the spherical housings of the diaphragm pump and motor assemblies 61A-C to inhibit accumulation of solid debris in the housings.

As illustrated only the second and third valves 68A and 78A of the uppermost diaphragm pump and motor assembly 61A are open, which permits the tailings stream pumped by the high pressure pump 76 to press the membrane 62A to the right as illustrated by arrow 85, thereby pumping hydrate slurry from the hydrate slurry containing chamber 63A into the slurry riser conduit 69.

Of the two lowermost diaphragm pump and motor assemblies 61B-C solely the first and fourth valves 56B-C and 80B-C are open, which permits the hydrate slurry 75 pumped by the pump 67 on the excavator to press the membranes 63B-C to the left as illustrated by arrows 87B-C, thereby pumping tailing streams 75 from the tailing stream containing chamber 64B-C via the tailings disposal pipe 79 to a tailings disposal site 88 at the water bottom 89.

Particularly if the subsea pumping station 60 is located at a large water depth from several hundred meters up to several kilometers then it is beneficial to use the tailing stream to power the diaphragm pump and motor assemblies 61A-C, since the tailing stream has a higher density than the surrounding seawater so that a relatively low power high pressure pump 76 may be used to pump the tailing stream into the tailings return conduit 77, which subsequently generates a much higher pressure in the diaphragm pump and motor assemblies 61A-C, due to the hydrostatic head of the tailing stream in the tailings return conduit 77.

Diaphragm pump and motor assemblies 61A-C are compact and robust and are able to significantly increase the pressure of the hydrate slurry 75 to such a high pressure that the slurry 75 is lifted in a turbulent flow regime through the slurry riser conduit 69 to the production vessel 70 at the water surface 71, thereby inhibiting plugging of the conduit 69 by hydrate and/or soil deposits. Diaphragm pump and motor assemblies 61A-C are in use in the mining industry and are able to pump soil slurries with a high content of solids over long periods of time.

The use of the diaphragm pump and motor assembly 61A-C and/or other slurry pumps actuated by the tailings stream 75 returning to the water bottom 89 allows to lift the hydrate slurry 73 to the topsides vessel 70 in an economic and reliable matter since at least part of the energy and pressure required to lift the hydrate slurry is recycled into the returning tailings stream 75, whereby the hydraulic head of the tailings stream 75 in the tailings return conduit 77 significantly reduces the power and hydraulic head that is to be generated by the high pressure pump 76 at the floating vessel 70, in particular if the pump and motor assembly 61A-C is arranged at a large water depth, which may range from several hundred meters to several kilometers below the water surface 71.

Figure 6:
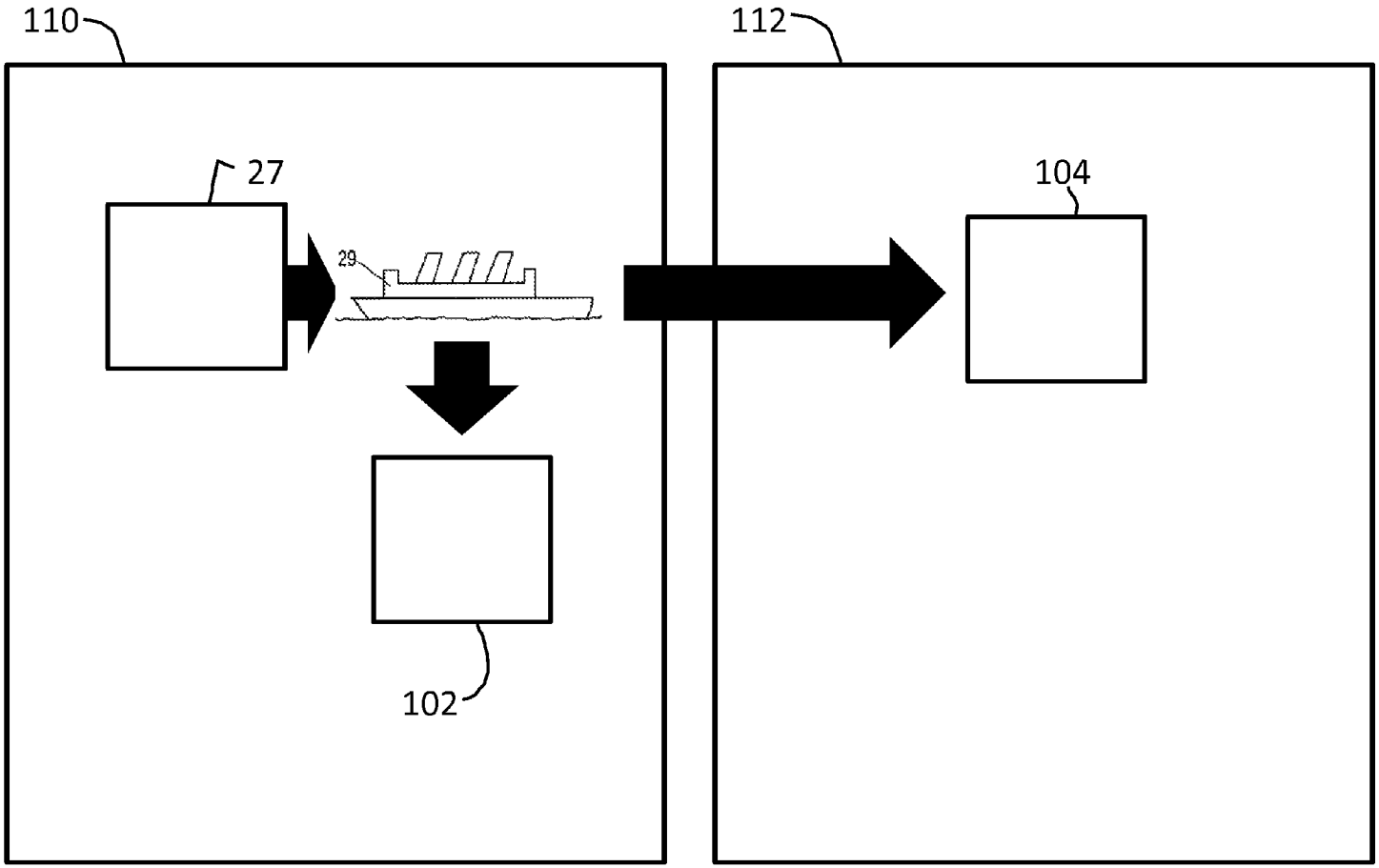

FIG. 6 depicts a block diagram of how transportable methane can be delivered to a facility. Transportable methane, which can include an intermediate product, can be loaded from a topside facility 27 onto a tanker 29. The topside facility 27 and tanker 29 can be located in an offshore area 110. The tanker 29 is then capable of moving the transportable methane to other locations. For example, the tanker 29 can transport the transportable methane to an offshore facility 102 also located in the offshore area 110. The tanker 29 can also transportable the transportable methane to an onshore facility 104 located in an onshore area 112. Both the offshore facility 102 and onshore facility 104 are capable of converting an intermediate product of transportable methane into a marketable hydrocarbon composition.

The invention claimed is:

1. A method for converting hydrates buried in a water bottom into a marketable hydrocarbon composition, the method comprising:

excavating hydrate, using an underwater excavator, from the water bottom, creating hydrate cuttings and mixing the excavated hydrate cuttings comprising water and bottom particles to form a pipeline transportable hydrate containing slurry;

lifting the slurry by means of a slurry lifting assembly comprising an underwater mixing chamber connected to the excavator, in which a chilled hydrocarbon carrier liquid is added to the slurry to convert the hydrate containing slurry into a chilled transportable methane containing intermediate product having a temperature below 0 degrees Celsius, through a riser conduit to a topsides vessel floating at the water surface, wherein the riser conduit comprises a lower section, an intermediate section, and a thermally insulated upper section, and wherein the mixing chamber is connected between the intermediate and upper sections of the riser conduit;

transporting the chilled transportable methane containing intermediate product through the thermally insulated upper section of the riser conduit to the topsides vessel, wherein the temperature of the chilled intermediate product is maintained below the ambient temperature of the surface water surrounding the topsides vessel;

separating the slurry in a slurry separation assembly at or near the topsides vessel, and arranged between the lower and intermediate sections of the riser conduit, into a transportable methane containing intermediate product and a tailings stream;

transporting the transportable methane containing intermediate product to a facility in which the intermediate product is converted into a marketable hydrocarbon composition; and, wherein the slurry lifting assembly comprises a slurry pump, which is actuated by the tailings stream.

2. The method of claim 1, wherein the topsides vessel is provided with: a thermally insulated storage tank for storing the chilled intermediate product; and a thermally insulated slurry export conduit for transferring the chilled intermediate product into a thermally insulated tank of a shuttle tanker, which is configured to ship the chilled intermediate product to an onshore facility for converting the intermediate product into one of a methane containing fuel and other marketable hydrocarbon composition.

3. The method of claim 2, wherein the excavator is a remotely operated crawler provided with tracks.

4. The method of claim 2, wherein the facility in which the intermediate product is converted into one of a methane containing fuel and other marketable hydrocarbon composition is an offshore or onshore facility for producing purified natural gas suitable for use as a domestic, transportation and/or industrial fuel and/or for producing Liquid Natural Gas (LNG) and/or for producing Gas To Liquid (GTL) compositions.

5. The method of claim 1, wherein the tailings stream is pumped down through a tailings return conduit to the slurry lifting assembly by a tailings injection pump at the topsides facility; the slurry pump is actuated by a hydraulic motor which is actuated by the tailings stream; and the tailings stream is discharged to a tailings disposal site at the water bottom via a flexible tailings disposal pipe which is connected to an outlet port of the hydraulic motor.

* * * * *